US011490480B1

(12) United States Patent
Li

(10) Patent No.: US 11,490,480 B1
(45) Date of Patent: Nov. 1, 2022

(54) LED SYSTEM WITH CONTROLLABLE POWER SUPPLY AND CONTROL METHOD AND DEVICE THEREOF

(71) Applicant: SHENZHEN SUNMOON MICROELECTRONICS CO., LTD., Guangdong (CN)

(72) Inventor: Zhaohua Li, Guangdong (CN)

(73) Assignee: SHENZHEN SUNMOON MICROELECTRONICS CO., LTD., Shenzhen (CN)

( * ) Notice: Subject to any disclaimer, the term of this patent is extended or adjusted under 35 U.S.C. 154(b) by 0 days.

(21) Appl. No.: 17/570,369

(22) Filed: Jan. 6, 2022

(30) Foreign Application Priority Data

Dec. 17, 2021 (CN) ..... 202111549678.1

(51) Int. Cl.
*H05B 45/30* (2020.01)
*H05B 45/14* (2020.01)

(52) U.S. Cl.
CPC ..... *H05B 45/30* (2020.01); *H05B 45/14* (2020.01)

(58) Field of Classification Search
CPC ..... H05B 45/00; H05B 45/30; H05B 45/347; H05B 45/14; H05B 47/20; H05B 47/21; G05F 1/56; G05F 1/563
See application file for complete search history.

(56) References Cited

U.S. PATENT DOCUMENTS 9,684,390 B2 * 6/2017 Ozawa ..... G06F 3/0481
2007/0226524 A1 * 9/2007 Nakamura ..... G06F 1/26 700/286
2010/0201278 A1 8/2010 Zhao
2011/0109231 A1 5/2011 Shiu et al.
2012/0029722 A1 * 2/2012 Lee ..... H02J 1/102 700/297
2012/0280632 A1 11/2012 Kim et al.
2013/0293208 A1 11/2013 D'Angelo et al.
2019/0281676 A1 * 9/2019 Sha ..... H05B 45/00
2020/0105185 A1 4/2020 Chen et al.

OTHER PUBLICATIONS

Search report of counterpart European Patent Application No. 22150487.1 dated Jun. 21, 2022.

* cited by examiner

*Primary Examiner* — Thai Pham

(57) ABSTRACT

The present application relates to an LED system with controllable power supply and control method and device thereof. The control method comprises: detecting output port voltages of a main driving module, and when a number of ports whose voltage is less than a first preset voltage or a number of ports whose voltage is greater than a second preset voltage exceeds a first preset value, coarsely adjusting the power supply; determining by each of cascaded slave driving modules an adjustment strategy according to its own output port voltages and an adjustment strategy from a subsequent slave driving module, and sending its adjustment strategy to a previous slave driving module; determining by the main driving module an adjustment strategy of the power supply according to the adjustment strategy from the slave driving module and the output port voltages of the main driving module, and fine-adjusting the power supply.

15 Claims, 3 Drawing Sheets

LED SYSTEM WITH CONTROLLABLE POWER SUPPLY AND CONTROL METHOD AND DEVICE THEREOF

CROSS-REFERENCE TO RELATED APPLICATIONS

The present application claims the benefit of Chinese Patent Application No. 202111549678.1 filed on Dec. 17, 2021. All the above are hereby incorporated by reference.

FIELD

The present application relates to LED (light-emitting diode) display driving technology, and in particular, to a control method and control device for power supply of an LED system and an LED system with controllable power supply.

BACKGROUND

With continuous development of LED lighting display technology, LED lamps are accepted by users due to their characteristics of low power consumption, long lifespan, convenient transportation, environmental protection, and pure colors.

Generally, a power supply device of an LED system powers the system with a constant voltage power supply mode, which cannot automatically adjust the supply voltage according to changes of parameters of the LED system. In this constant voltage power supply mode, in order to ensure LED lighting/display effect, the power supply device of the LED system usually selects a higher power supply voltage level, which will result in high power consumption of the entire LED system. The power supply device will choose a lower power supply voltage level in order to reduce power consumption of the LED system, but due to inconsistent forward voltage (VF) of the LEDs, and with temperature changes, aging, etc., forward voltage of the LEDs will change. Therefore, in the low power consumption mode, there may be a problem of insufficient power supply voltage level, which affects the lighting/display effect.

SUMMARY

The technical problem to be solved by the present application is to provide a control method and control device for power supply of an LED system and an LED system with controllable power supply to reduce the power consumption as much as possible while ensuring the lighting/display effect of the LEDs.

According to a first aspect of the present application, a control method for power supply of an LED system is provided, used in an LED drive circuit comprising a main driving module connected to the power supply and multiple cascaded slave driving modules, comprising the following steps:

S1. Detecting multiple output port voltages of multiple output ports of the main driving module, and when a number of ports whose output port voltage is less than a first preset voltage or a number of ports whose output port voltage is greater than a second preset voltage exceeds a first preset value, coarsely adjusting the power supply with a coarse adjustment gear;

S2. Determining by each of the multiple slave driving modules an adjustment strategy of a current slave driving module according to output port voltages of the current slave driving module and an adjustment strategy from a subsequent slave driving module, and sending the adjustment strategy to a previous slave driving module;

S3. Determining by the main driving module an adjustment strategy of the power supply according to the adjustment strategy from the slave driving module that is connected with the main driving module and the output port voltages of the main driving module, and fine-adjusting the power supply with a fine adjustment gear.

In an embodiment of the control method according to the first aspect of the present application, the step S1 comprises:

S11. Detecting multiple output port voltages of multiple output ports of the main driving module;

S12. Counting a number of ports whose voltage is less than a first preset voltage and a number of ports whose voltage is greater than a second preset voltage among the multiple output ports;

S13. When the number of ports whose voltage is less than the first preset voltage in the multiple output ports is greater than a first preset value, coarsely adjusting the power supply upward, and when the number of ports whose voltage is greater than the second preset voltage in the multiple output ports is greater than the first preset value, coarsely adjusting the power supply downward.

In an embodiment of the control method according to the first aspect of the present application, the step S2 comprises:

S21. Detecting output port voltages of multiple output ports of a current slave driving module;

S22. Determining whether the output port voltages are all greater than a lower limit of a feedback voltage threshold, if yes, proceeding to Step S24, and if not, proceeding to Step S23;

S23. Generating an adjustment strategy of upward fine adjustment for the current slave driving module, and sending the adjustment strategy of upward fine adjustment to a previous slave driving module;

S24. Determining whether the output port voltages are all greater than an upper limit of the feedback voltage threshold, if yes, proceeding to Step S25;

S25. Determining whether an adjustment strategy from a subsequent slave driving module is upward fine adjustment, if yes, proceeding to Step S23, and if not, generating an adjustment strategy of downward fine adjustment for the current slave driving module, and sending the adjustment strategy of downward fine adjustment to the previous slave driving module.

In an embodiment of the control method according to the first aspect of the present application, in the Step S3, when the output port voltages of the multiple output ports of the main driving module are not all greater than the lower limit of the feedback voltage threshold or the adjustment strategy from the subsequent slave driving module is upward fine adjustment, the power supply is fine-adjusted upward; and when the output port voltages of the multiple output ports of the main driving module are all greater than the upper limit of the feedback voltage threshold and the adjustment strategy from the subsequent slave driving module is not the upward fine adjustment, the power supply is fine-adjusted downward.

In an embodiment of the control method according to the first aspect of the present application, before the step S1, the control method further comprises:

S0. Performing by the main driving module an initial adjustment with an initial adjustment gear on the power supply according to a number of series-connected light points and a supply gear of the power supply detected when power-on.

In an embodiment of the control method according to the first aspect of the present application, between the Step S1 and the Step S2, the control method further comprises:

S01. Determining whether the output port voltages of the main driving module and the multiple slave driving modules are abnormal, if any one is abnormal, the output port voltage is not used in a calculation of the adjustment strategy.

According to a second aspect of the present application, a control device for power supply of an LED system is provided, connected to the power supply of the LED system, comprising a port voltage detection unit, a feedback calculation unit and a feedback unit, wherein the port voltage detection unit is configured to detect output port voltages of multiple output ports; the feedback calculation unit is configured to generate a coarse adjustment strategy when a number of ports whose output port voltage is less than a first preset voltage or a number of ports whose output port voltage is greater than a second preset voltage exceeds a first preset value, and is further configured to generate a fine adjustment strategy based on the output port voltages and a feedback voltage threshold after a coarse adjustment is performed; and the feedback unit is configured to adjust a supply voltage of the power supply according to a feedback voltage adjustment step, the coarse adjustment strategy and the fine adjustment strategy.

In an embodiment of the control device according to the second aspect of the present application, the control device further comprises a power supply detection unit and an adjustment unit; the power supply detection unit is configured to obtain the supply voltage of the power supply of the LED system by means of resistance voltage division; the adjustment unit is configured to determine the feedback voltage adjustment step; the feedback calculation unit is further configured to determine a supply gear of the power supply according to the supply voltage, and generates an initial adjustment strategy according to the supply gear and a number of series-connected light points; and the feedback unit is further configured to adjust the supply voltage of the power supply according to the feedback voltage adjustment step and the initial adjustment strategy.

In an embodiment of the control device according to the second aspect of the present application, the control device further comprises an inter-chip communication unit which is configured for inter-chip transmission of adjustment strategies.

According to a third aspect of the present application, an LED system with a controllable power supply is provided, comprising a power supply, an LED driving circuit and LED light strings, the LED driving circuit comprising a main driving module and multiple cascaded slave driving modules, wherein the main driving module and the multiple slave driving modules are configured with a control device for power supply of the LED system; the main driving module detects multiple output port voltages of multiple output ports of the main driving module, and when a number of ports whose output port voltage is less than a first preset voltage or a number of ports whose output port voltage is greater than a second preset voltage exceeds a first preset value, coarsely adjusts the power supply with a coarse adjustment gear; each of the multiple slave driving modules determines an adjustment strategy of a current slave driving module according to output port voltages of the current slave driving module and an adjustment strategy from a subsequent slave driving module, and sends the adjustment strategy to a previous slave driving module; and the main driving module determines an adjustment strategy of the power supply according to the adjustment strategy from the slave driving module that is connected with the main driving module and the output port voltages of the main driving module, and fine-adjusting the power supply with a fine adjustment gear.

In an embodiment of the LED system according to the third aspect of the present application, the control device in the main driving module comprises a port voltage detection unit, a feedback calculation unit and a feedback unit, wherein the port voltage detection unit is configured to detect output port voltages of multiple output ports; the feedback calculation unit is configured to generate a coarse adjustment strategy when a number of ports whose output port voltage is less than a first preset voltage or a number of ports whose output port voltage is greater than a second preset voltage exceeds a first preset value, and is further configured to generate a fine adjustment strategy based on the output port voltages and a feedback voltage threshold after a coarse adjustment is performed; and the feedback unit is configured to adjust a supply voltage of the power supply according to a feedback voltage adjustment step, the coarse adjustment strategy and the fine adjustment strategy.

In an embodiment of the LED system according to the third aspect of the present application, the control device in the main driving module further comprises a power supply detection unit and an adjustment unit; the power supply detection unit is configured to obtain the supply voltage of the power supply of the LED system by means of resistance voltage division; the adjustment unit is configured to determine the feedback voltage adjustment step; the feedback calculation unit is further configured to determine a supply gear of the power supply according to the supply voltage, and generates an initial adjustment strategy according to the supply gear and a number of series-connected light points; and the feedback unit is further configured to adjust the supply voltage of the power supply according to the feedback voltage adjustment step and the initial adjustment strategy.

In an embodiment of the LED system according to the third aspect of the present application, the control device in the main driving module further comprises an inter-chip communication unit which is configured for inter-chip transmission of adjustment strategies.

In an embodiment of the LED system according to the third aspect of the present application, the control device in each of the multiple slave driving modules comprises a port voltage detection unit, a feedback calculation unit, and an inter-chip communication unit; the port voltage detection unit is configured to detect output port voltages of a current slave driving module; the feedback calculation unit is configured to calculate an adjustment strategy of the current slave driving module; and the inter-chip communication unit is configured for inter-chip transmission of the adjustment strategy.

In an embodiment of the LED system according to the third aspect of the present application, the feedback calculation unit of the slave driving module determines the adjustment strategy of the current slave driving module according to the output port voltages of the current slave driving module and an adjustment strategy from a subsequent slave driving module, and send the adjustment strategy to a previous slave driving module through the inter-chip communication unit.

Implementing the embodiments of the present application has the following beneficial effects:

1. By detecting the output port voltages of the output ports, the abnormal port can be detected and excluded, and a separate abnormal detection module is not needed.

2. The main driving module can initially adjust the supply voltage of the LED system to a required voltage range according to the supply voltage of the power supply detected by the power supply detection unit and the number of series-connected light points. Thus the supply voltage of the power supply of the LED system is directly adjusted to a required voltage level to speed up the system power supply adjustment speed, and at the same time reduce the design requirements for the system power supply.

3. After the LED system starts to work, the main driving module can generate a coarse adjustment strategy according to the output port voltages, the first preset voltage and the second preset voltage, and quickly adjust the supply voltage of the power supply of the LED system to a reasonable voltage range.

4. After the abnormal ports are excluded and the coarse adjustment is performed, each of the multiple slave driving modules can determine the direction in which the supply voltage of the power supply of the LED system needs to be adjusted according to the output port voltages, and pass it to the previous slave driving module via data serial protocol communication, until to the main driving module. Then the main driving module finally determines the fine adjustment strategy of the supply voltage of the power supply of the LED system according to the passed adjustment strategy and its own output port voltages. Through the fine adjustment, the supply voltage of the power supply of the LED system can be gradually adjusted to the lowest voltage level of the LED system on the basis of ensuring the effect of the LED system.

5. The adjustment step of the feedback unit can be determined according to the resistance value of the external resistor, ensuring that the adjustment capability of the feedback unit can be adapted to the voltage feedback function of the power supply of different LED systems.

BRIEF DESCRIPTION OF THE DRAWINGS

In order to explain the embodiments of the present application or the technical solutions in the prior art more clearly, the following will briefly introduce drawings that need to be used in the description of the embodiments or the prior art. Obviously, the drawings in the following description only show some embodiments of the present application. For those of ordinary skill in the art, other drawings can be obtained based on these drawings without creative work. In the accompanying drawings.

DETAILED DESCRIPTION

The technical solutions in the embodiments of the present application will be clearly and completely described below in conjunction with the accompanying drawings in the embodiments of the present application. Obviously, the described embodiments are only a part of the embodiments of the present application, rather than all the embodiments. Based on the embodiments of the present application, all other embodiments obtained by those of ordinary skill in the art without creative work shall fall within the protection scope of the present application.

Figure 1:
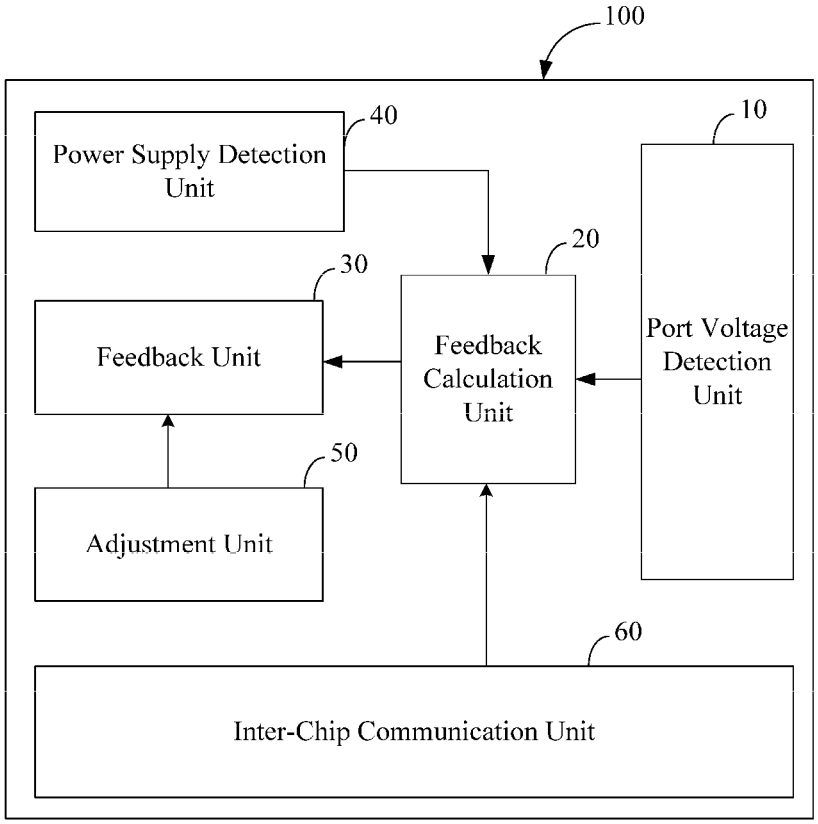
FIG. 1 is a schematic block diagram of a control device for power supply of an LED system according to an embodiment of the present application.

FIG. 1 is a schematic block diagram of a control device for power supply of an LED system according to an embodiment of the present application. As shown in FIG. 1, the control device 100 comprises a port voltage detection unit 10, a feedback calculation unit 20, a feedback unit 30, a power supply detection unit 40, an adjustment unit 50, and an inter-chip communication unit 60. The port voltage detection unit 10 is configured to detect an output port voltage. The feedback calculation unit 20 is configured to generate a coarse adjustment strategy when a number of ports whose output port voltage is less than a first preset voltage or a number of ports whose output port voltage is greater than a second preset voltage exceeds a first preset value. The feedback calculation unit 20 is further configured to generate a fine adjustment strategy based on the output port voltages and a feedback voltage threshold after a coarse adjustment is performed. The feedback unit 30 is configured to adjust a supply voltage of the power supply according to a feedback voltage adjustment step, the coarse adjustment strategy and the fine adjustment strategy. The power supply detection unit 40 is configured to obtain the supply voltage of the power supply of the LED system by means of resistance voltage division. The feedback calculation unit 20 is further configured to determine a supply gear of the power supply according to the supply voltage, and generates an initial adjustment strategy according to the supply gear and a number of series-connected light points. The feedback unit is further configured to adjust the supply voltage of the power supply according to the feedback voltage adjustment step and the initial adjustment strategy. The adjustment unit 50 is configured to determine the feedback voltage adjustment step. The inter-chip communication unit 60 is configured for inter-chip transmission of adjustment strategies.

Figure 2:
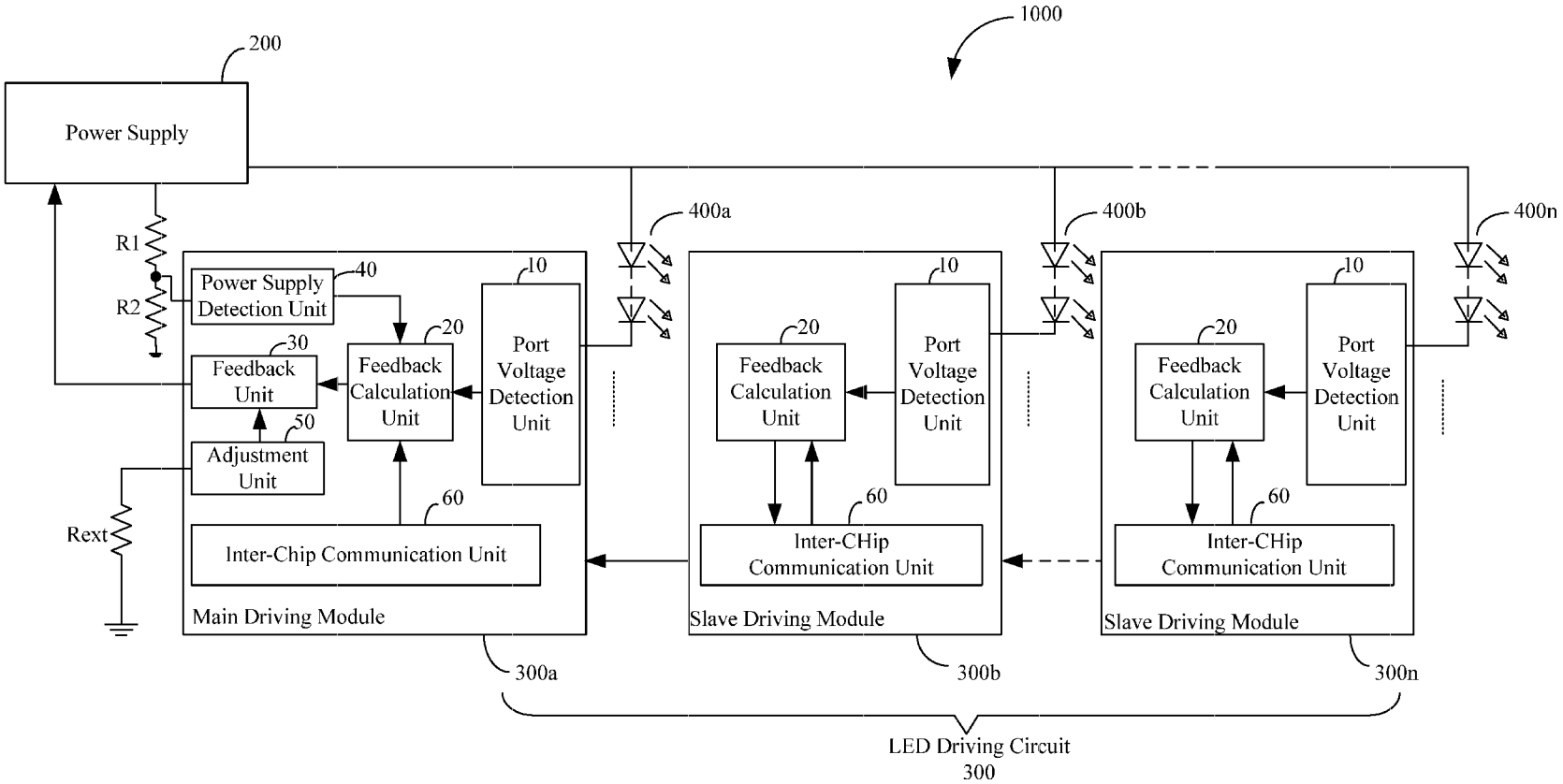
FIG. 2 is a circuit block diagram of an LED system with controllable power supply according to an embodiment of the present application.

FIG. 2 is a circuit block diagram of an LED system with controllable power supply according to an embodiment of the present application. As shown in FIG. 2, the LED system 1000 comprises a power supply 200, an LED driving circuit 300, and LED light strings 400*a*, 400*b*, . . . 400*n*. The LED driving circuit 300 further comprises a main driving module 300*a* and multiple cascaded slave driving modules 300*b*, . . . 300*n*. Those skilled in the art can understand that both the main driving module 300*a* and the slave driving modules 300*b*, . . . 300*n* can be configured with the control device 100 as shown in FIG. 2. For the convenience of description, the units of the control device 100 that is not used by the slave driving modules 300*b*, . . . 300*n* are not shown in the figure. That is to say, only the port voltage detection unit 10, the feedback calculation unit 20, and the inter-chip communication unit 60 are shown in the slave driving module 300*b*, . . . 300*n* in FIG. 2. Further, the main driving module 300*a* refers to a driving module connected to the power supply, which can adjust a feedback voltage of the power supply, and can be a first one of a string of LED driving modules or a last one of a string of LED driving modules. The present application is not limited to this. The multiple LED driving modules communicate with each other via a data serial communication protocol. When the main driving module is the first one of the multiple driving modules, a direction of data communication is from the last driving module to the first driving module. When the main driving module is the last one of the multiple driving modules, the direction of data communication is from the first driving module to the last driving module. Here, the first driving module refers to a module that receives signals from a controller, and the last driving module refers to a module that sends data to the controller.

Specifically, as shown in FIG. 2, the main driving module 300*a* comprises a port voltage detection unit 10, a feedback calculation unit 20, a feedback unit 30, a power supply detection unit 40, an adjustment unit 50, and an inter-chip communication unit 60. The port voltage detection unit 10 is configured to detect the output port voltage. The feedback calculation unit 20 is configured to calculate the adjustment strategies of the power supply 200. The inter-chip communication unit 60 is configured for inter-chip transmission of the adjustment strategies of the supply voltage via data serial protocol communication. The power supply detection unit 40 is configured to detect the supply voltage of the LED system 1000. The adjustment unit 50 is configured to determine the feedback voltage adjustment step. The feedback unit 30 is configured to adjust the supply voltage of the power supply 200 according to the adjustment strategies and the feedback voltage adjustment step.

Further, in an embodiment of the present application, the port voltage detection unit 10 of the main driving module 300*a* is configured to detect the output port voltages of multiple output ports of the main driving module 300*a* after power-on, and send the detected output port voltages to the feedback calculation unit 20. The port voltage detection unit 10 can detect the output port voltages through real-time detection, interval setting frame detection, etc. A detection frequency of the port voltage detection unit 10 can also be set according to actual needs, such as real-time adjustment, interval setting frame adjustment, etc.

Further, in an embodiment of the present application, the power supply detection unit 40 is connected to a power output port of the power supply 200, obtains the supply voltage of the power supply 200 by means of dividing the supply voltage with external resistors R1 and R2, and feeds back a detection result to the feedback calculation unit 20 of the main driving module 300*a*. The feedback calculation unit 20 of the main driving module 300*a* generates an initial adjustment strategy according to a voltage value detected by the power supply detection unit 40 and a number of series-connected light points. Here, the number of series-connected light points refers to a number of LED lights series-connected to one output port. The supply voltage of the power supply 200 can be adjusted to an approximate voltage level via an initial adjustment signal of the initial adjustment strategy. This adjustment is an initial adjustment of the supply voltage of the power supply 200 of the LED system 1000, with a large adjustment gear step, such as 3V per step. This function can also be disabled, and the power supply of the LED system adjusts the supply voltage itself.

Further, in an embodiment of the present application, the feedback calculation unit 20 of the main driving module 300*a* generates a coarse adjustment strategy when a number of ports whose output port voltage is less than a first preset voltage or a number of ports whose output port voltage is greater than a second preset voltage exceeds a first preset value. Here, the first preset voltage refers to an open circuit detection voltage, that is, when the output port voltage is less than the first preset voltage, the port is open. The second preset voltage refers to a short circuit detection voltage, that is, when the output port voltage is greater than the second preset voltage, the port is short-circuited. Furthermore, if half of the ports are open, it is considered that the supply voltage of the power supply of the LED system is too low. At this time, an upward coarse adjustment strategy is generated to increase the supply voltage of the power supply. If half of the ports are short-circuited, then it is considered that the supply voltage of the power supply of the LED system is too large. At this time, a downward coarse adjustment strategy is generated to lower the supply voltage of the power supply. By coarse adjustment, the supply voltage of the power supply of the LED system can be quickly adjusted to a reasonable voltage range of the LED system.

Further, in an embodiment of the present application, after the coarse adjustment is performed, the feedback calculation unit 20 of the main driving module 300*a* also determines whether the output port voltages are abnormal under premise of ensuring that the supply voltage is normal. If the output port voltage of a certain port is less than a third preset voltage or greater than a fourth preset voltage, and the other ports are normal, it is determined that the port is abnormal, and the output port voltage of the port is not used in calculation of the adjustment strategy. Here the third preset voltage refers to an open circuit detection voltage, that is, when the output port voltage is less than the third preset voltage, the port is open; and the fourth preset voltage refers to a short circuit detection voltage, that is, when the output port voltage is greater than the fourth preset voltage, the port is short-circuited. Those skilled in the art can understand that the third preset voltage and the fourth preset voltage may be the same as or different from the first preset voltage and the second preset voltage, respectively, and the present application is not limited thereto. Therefore, abnormality detection can be realized by the feedback calculation unit 20, without a need for a separate abnormality detection module. Those skilled in the art can understand that the abnormality detection function may or may not be enabled, depending on a specific selection according to the situations by users.

Further, in an embodiment of the present application, after the coarse adjustment is performed, the feedback calculation unit 20 of the main driving module 300*a* is also configured to generates a fine adjustment strategy according to an adjustment strategy from a slave driving module 300*b* that is connected to it and the output port voltages of the main driving module 300*a*. If any one of the multiple output port voltages of the main driving module 300*a* is less than a lower limit of the feedback voltage threshold, the feedback calculation unit 20 generates an upward fine adjustment strategy; if the adjustment strategy from the subsequent slave driving module 300*b* is an upward fine adjustment strategy, the feedback calculation unit 20 generates an upward fine adjustment strategy; and if the multiple output port voltages of the main driving module 300*a* are all greater than a upper limit of the feedback voltage threshold and the adjustment strategy from the subsequent slave driving module 300*b* is not an upward fine adjustment strategy, the feedback calculation unit 20 generates a downward fine adjustment strategy. By fine adjustment, the supply voltage of the power supply of the LED system can be gradually adjusted to a lowest voltage level of the LED system on the basis of ensuring the effect of the LED system.

Further, in an embodiment of the present application, the adjustment unit 50 is configured to determine a feedback voltage adjustment step. Specifically, a size of a single adjustment gear of the feedback voltage of the feedback unit 30 of the main driving module 300*a* can be determined by means of a register or by changing resistance value of an external resistor Rext of the adjustment unit 50 of the main driving module 300*a*. In practical applications, if the value of the register can meet the requirements, the external resistor Rext is not needed. The adjustment unit 50 can adjust adjustment capability of the feedback unit 30 according to the resistance value of the external resistor to ensure that the adjustment capability of the feedback unit 30 can be adapted to voltage feedback function of the power supply of different LED systems.

Further, in an embodiment of the present application, the feedback unit 30 is configured to perform an adjustment on the supply voltage of the power supply according to the feedback voltage adjustment step from the adjustment unit 50 and the adjustment strategy from the feedback calculation unit 20. The feedback unit 30 adjusts the supply voltage of the power supply of the LED system to an optimal voltage level by means of the feedback voltage function of the power supply of the LED system according to the adjustment strategy obtained by the feedback calculation unit 20. An adjustment frequency of the feedback unit 30 can be set according to actual needs, such as real-time adjustment, interval setting frame adjustment, etc.

Specifically, as shown in FIG. 2, each slave driving module 300*b*, . . . 300*n* comprises a port voltage detection unit 10, a feedback calculation unit 20, and an inter-chip communication unit 60. The port voltage detection unit 10 is configured to detect the output port voltage, the feedback calculation unit 20 is configured to calculate the adjustment strategy of the current slave driving module, and the inter-chip communication unit 60 is configured for inter-chip transmission of the adjustment strategy via data serial protocol communication.

Further, in an embodiment of the present application, the port voltage detection unit 10 of each slave driving module 300*b*, . . . 300*n* is further configured to detect the output port voltages of multiple output ports of the slave driving module 300*b*, . . . 300*n* after power-on, and sends the detected output port voltage to the feedback calculation unit 20. The port voltage detection unit 10 can detect the output port voltage through real-time detection, interval setting frame detection, etc., and a detection frequency of the port voltage detection unit 10 can also be set according to actual needs, such as real-time adjustment, interval setting frame adjustment, etc.

Further, in an embodiment of the present application, the feedback calculation unit 20 of each slave driving module 300*b*, . . . 300*n* firstly determines whether the output port voltages are abnormal. If the output port voltage of a certain port is less than a third preset voltage or greater than a fourth preset voltage, and the other ports are normal, it is determined that said port is abnormal, and the output port voltage of said port is not used in calculation of the adjustment strategy. Here the third preset voltage refers to an open circuit detection voltage, that is, when the output port voltage is less than the third preset voltage, the port is open; and the fourth preset voltage refers to a short circuit detection voltage, that is, when the output port voltage is greater than the fourth preset voltage, the port is short-circuited. Those skilled in the art can understand that the third preset voltage and the fourth preset voltage may be the same as or different from the first preset voltage and the second preset voltage, respectively, and the present application is not limited thereto. Therefore, abnormality detection can be realized by the feedback calculation unit 20, without a need for a separate abnormality detection module. Those skilled in the art can understand that the abnormality detection function may or may not be enabled, depending on a specific selection according to the situations by users.

Further, in an embodiment of the present application, the feedback calculation unit 20 of each slave driving module 300*b*, . . . 300*n* determines the adjustment strategy of the current slave driving module according to the output port voltages of the current slave driving module and the adjustment strategy from a subsequent slave driving module, and send the adjustment strategy to a previous slave driving module through the inter-chip communication unit 60. After the abnormal port is removed, a direction in which the supply voltage of the power supply of the LED system needs to be adjusted is determined according to the output port voltages of the current slave driving module, and is transmitted to the previous slave driving module via data serial protocol communication, until to the main driving module. Each of the slave driving modules synthesize the adjustment strategy of the subsequent slave driving module and the output port voltages detected by its own port voltage detection unit to obtain a new adjustment strategy, and then pass it to the previous slave driving module via data serial protocol communication.

The LED system with controllable power supply according to the embodiments of the present application has the following advantages:

1. The main driving module can initially adjust the supply voltage of the LED system to a required voltage range according to the supply voltage of the power supply detected by the power supply detection unit and the number of series-connected light points.

2. After the LED system starts to work, the main driving module can generate a coarse adjustment strategy according to the output port voltages, the first preset voltage and the second preset voltage, and quickly adjust the supply voltage of the power supply of the LED system to a reasonable voltage range.

3. By detecting the output port voltages of the output ports, the abnormal port can be detected and excluded, and a separate abnormal detection module is not needed.

4. After the abnormal ports are excluded and the coarse adjustment is performed, each of the multiple slave driving modules can determine the direction in which the supply voltage of the power supply of the LED system needs to be adjusted according to the output port voltages, and pass it to the previous slave driving module via data serial protocol communication, until to the main driving module. Then the main driving module finally determines the fine adjustment strategy of the supply voltage of the power supply of the LED system according to the passed adjustment strategy and its own output port voltages. Through the fine adjustment, the supply voltage of the power supply of the LED system can be gradually adjusted to the lowest voltage level of the LED system on the basis of ensuring the effect of the LED system.

5. The adjustment unit can determine the adjustment step of the feedback unit according to the resistance value of the external resistor, ensuring that the adjustment capability of the feedback unit can be adapted to the voltage feedback function of the power supply of different LED systems.

The following describes in detail a working process of the LED system with controllable power supply according to the embodiments of the present application, wherein 1# driver IC represents the main driving module, and 2# driver IC to N # driver IC represent the slave driving modules:

(1) By changing the value of the register for feedback voltage adjustment gear of 1# driver IC or changing the resistance value of the external resistor Rext of the adjustment unit, the adjustment unit of 1# driver IC determines the size of a single feedback voltage adjustment gear of the feedback unit of 1# driver IC.

(2) The power supply detection unit of 1# driver IC obtains the supply voltage of the power supply of the LED system by means of resistance voltage division, and feeds back the obtained result to the feedback calculation unit of 1# driver IC.

(3) The feedback calculation unit determines the adjustment gear of the feedback voltage according to the supply voltage fed back by the power supply detection unit and the number of series-connected LED lights, and at the same time sends the feedback voltage adjustment information to the feedback unit, and the feedback unit sends a adjustment gear corresponding to the feedback voltage adjustment information to the power supply of the LED system, so as to adjust the supply voltage of the LED system to a required voltage range.

(4) After the system starts to work, the port voltage detection unit of the 2#~N # driver ICs will detect the output port voltages in real time, and send the output port voltage detection result to the feedback calculation unit of the current driver IC.

(5) The feedback calculation unit determines whether the supply voltage needs to be increased or decreased according to the detection result of the port voltage detection unit and the feedback information transmitted by the subsequent driver IC through the inter-chip communication unit, and transmits its feedback information through the inter-chip communication unit to the previous driver IC. The detailed steps comprise: a) the N # driver IC uses the detection result of the port voltage detection unit to determine an adjustment strategy of the supply voltage of the LED system and transmits it to the (N−1)# driver IC through the inter-chip communication unit; b) the (N−1)# driver IC integrates the detection result of its own port voltage detection unit and the adjustment strategy of the supply voltage of the N # driver IC transmitted to the (N−1)# driver IC through the inter-chip communication unit, to determine an adjustment strategy of the supply voltage of the (N−1)# driver IC, and transmits the adjustment strategy of the (N−1)# driver IC to the (N−2)# driver through the inter-chip communication unit IC, and such a cycle continues until it reaches the 1# driver IC.

(6) After the 1# driver IC receives the adjustment strategy of the supply voltage from the 2# driver IC through the inter-chip communication unit, it passes the adjustment strategy of the supply voltage from the 2# driver IC to its feedback calculation unit, and then the feedback calculation unit of the 1# driver IC integrates the adjustment strategy of the supply voltage of the 2# driver IC and the detection result of the port voltage detection unit of the 1# driver IC, to determine a final adjustment strategy of the supply voltage of the LED system and sends it to the feedback unit of the 1# driver IC.

(7) The feedback unit of the 1# driver IC realizes a real-time adjustment on the supply voltage of the power supply of the LED system by means of the feedback function of the power supply of the LED system according to the adjustment strategy of the supply voltage given by the feedback calculation unit of the 1# driver IC.

Figure 3:
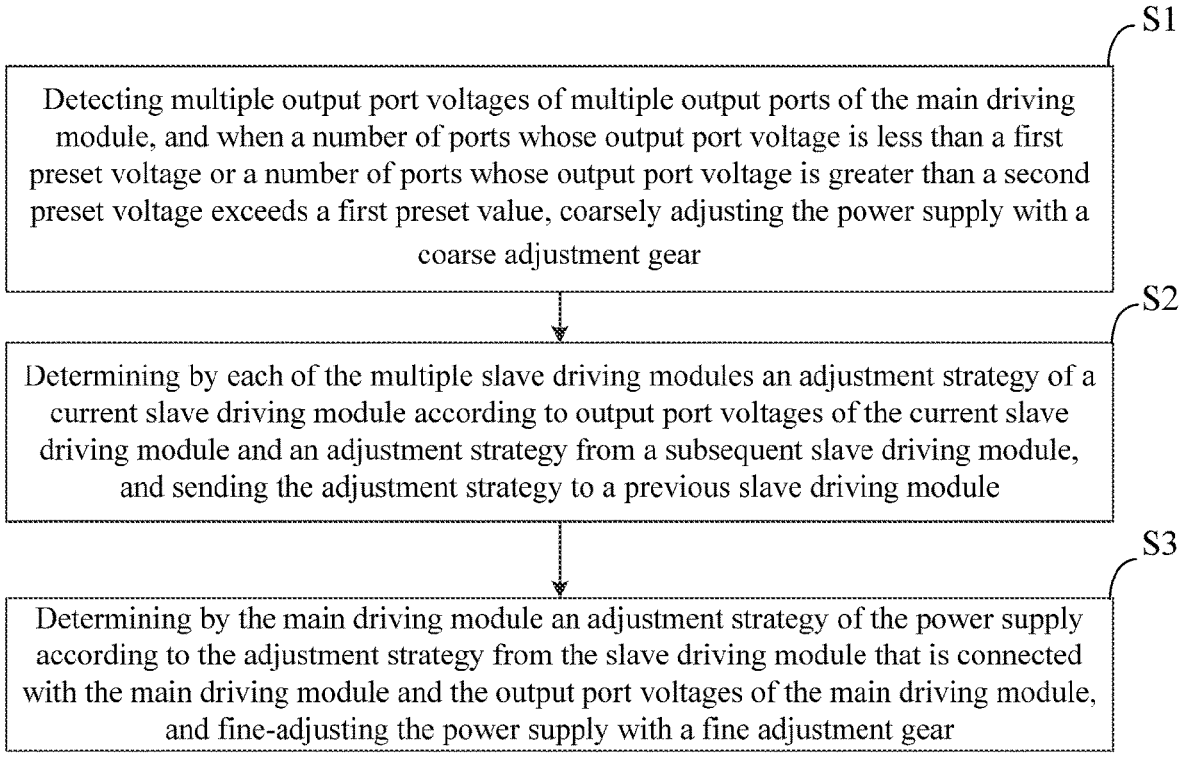
FIG. 3 is a flowchart of a control method for power supply of an LED system according to an embodiment of the present application.

FIG. 3 is a flowchart of a control method for power supply of an LED system according to an embodiment of the present application. The following describes the control method for power supply of an LED system of the present application in detail:

In a Step S0, the main driving module uses an initial adjustment gear to perform an initial adjustment on the power supply according to a number of series-connected light points and the supply gear detected when power-on.

Specifically, in an embodiment of the present application, the power supply voltage detection unit of the main driving module of the LED system stores the detected supply voltage of the power supply of the LED system in an internal register. The system controller writes the number of series-connected light points in a single output port to the internal register of the main driving module of the LED system based on the actual situation of the LED system. The main driving module of the LED system initially adjusts the supply voltage of the LED system according to the number of series-connected light points and the supply gear detected when power-on. This adjustment is an initial adjustment of the power supply of the LED system, and the adjustment gear has a large step, such as 3V/step. This function can also be disabled, and the power supply of the LED system itself adjusts the supply voltage.

In a Step S1, the multiple output port voltages of the multiple output ports of the main driving module are detected, and when the number of ports whose output port voltage is less than the first preset voltage or the number of ports whose output port voltage is greater than the second preset voltage exceeds the first preset value, a coarse adjustment gear is used to coarsely adjust the power supply.

Specifically, in an embodiment of the present application, if Vout<the first preset voltage (register is adjustable), it is considered that the port is open; if Vout>the second preset voltage (register is adjustable), it is considered that the port is short-circuited. If there is half of the results of the port indicates an open circuit or a short circuit, it is considered to be the power supply problem of the LED system, and the supply voltage needs to be coarsely adjusted. Further, if it is detected that a set number of ports whose voltage exceeds the open-circuit threshold, that is, the first preset voltage, the supply voltage of the power supply of the LED system is coarsely adjusted upward by one gear, and the adjustment step is large, such as 0.6V/step. If the port voltage detection unit of the main driving module detects that a set number of ports whose voltage exceeds the short-circuit threshold, that is, the second preset voltage, the supply voltage of the power supply of the LED system is coarsely adjusted downward by one gear, and the adjustment gear step is large, such as 0.6 V/step. Therefore, the Step S1 comprises:

Step S11. Detecting multiple output port voltages of the multiple output ports of the main driving module;

Step S12. Counting the number of ports whose voltage is less than the first preset voltage and the number of ports whose voltage is greater than the second preset voltage among the multiple output ports;

Step S13. When the number of ports whose voltage is less than the first preset voltage in the multiple output ports is greater than the first preset value, the supply voltage of the power supply is coarsely adjusted upward, and when the number of ports whose voltage is greater than the second preset voltage in the multiple output ports is greater than the first preset value, the supply voltage of the power supply is coarsely adjusted downward.

Further, after the coarse adjustment is performed in the Step S1, the control method further comprises in a Step S01, determining whether the output port voltages of the main driving module and the multiple slave driving modules are abnormal, if any one of the output ports of them is abnormal, the output port voltage of the output port is not used in the calculation of the adjustment strategy.

Specifically, in an embodiment of the present application, the output port voltages detected by the port voltage detection units of the main driving module and the slave driving modules are compared with the preset abnormal threshold to determine whether the port is abnormal. If the output port voltage of a port is less than the third preset voltage or greater than the fourth preset voltage, but the other ports are normal, it is determined that the port is abnormal, and the output port voltage of the port is not used in calculation of the adjustment strategy. Here the third preset voltage refers to an open circuit detection voltage, that is, when the output port voltage is less than the third preset voltage, the port is open; and the fourth preset voltage refers to a short circuit detection voltage, that is, when the output port voltage is greater than the fourth preset voltage, the port is short-circuited. Those skilled in the art can understand that the third preset voltage and the fourth preset voltage may be the same as or different from the first preset voltage and the second preset voltage, respectively, and the present application is not limited thereto.

Further, when a number of the ports that is open of the current driving module is greater than a preset value (that is, only when at least W ports are opened in each frame, the voltage detection is performed when the ports are opened), the port voltage detection unit of the current driving module starts to detect the output port voltages of the ports.

In a Step S2, each of the multiple slave driving modules determines its own adjustment strategy according to the output port voltages of the current slave driving module and the adjustment strategy from the subsequent slave driving module, and sends its adjustment strategy to the previous slave driving module through the inter-chip communication unit.

Specifically, in an embodiment of the present application, after the abnormal port of each driving module is removed, the output port voltages of the normal ports are compared with the feedback voltage threshold. If the output port voltage of any normal output port in a certain slave driving module is less than the lower limit of the feedback voltage threshold, the adjustment strategy of the slave driving module is upward adjustment with one gear. If a certain slave driving module receives an adjustment strategy of upward adjustment with one gear from the subsequent driving module, no matter what the adjustment strategy of the current driving module is, it sends the adjustment strategy of upward adjustment with one gear to the previous driving module, until the adjustment strategy of upward adjustment with one gear is transmitted to the main driving module. If the output port voltages of all normal output ports in a certain slave driving module are greater than the upper limit of the feedback voltage threshold, the adjustment strategy of the slave driving module is downward adjustment with one gear. At this time, if the inter-chip communication unit does not receive an adjustment strategy of upward adjustment with one gear from the subsequent slave driving module, the current driving module sends the adjustment strategy of downward adjustment with one gear through the inter-chip communication unit to the previous driving module; and if the inter-chip communication unit receives an adjustment strategy of upward adjustment with one gear from the subsequent slave driving module, the current slave driving module sends the adjustment strategy of upward adjustment with one gear through the inter-chip communication unit to the previous driving module, until the adjustment strategy of upward adjustment with one gear is transmitted to the main driving module. Therefore, the Step S2 comprises:

Step S21: Detecting output port voltages of multiple output ports of a current slave driving module;

Step S22: Determining whether the output port voltages are all greater than the lower limit of the feedback voltage threshold, if yes, proceeding to Step S24, and if not, proceeding to Step S23;

Step S23: Generating an adjustment strategy of upward fine adjustment for the current slave driving module, and sending the adjustment strategy of upward fine adjustment to a previous slave driving module;

Step S24: Determining whether the output port voltages are all greater than the upper limit of the feedback voltage threshold, if yes, proceeding to Step S25;

Step S25: Determining whether the adjustment strategy from the subsequent slave driving module is upward fine adjustment, if yes, proceeding to Step S23, and if not, generating an adjustment strategy of downward fine adjustment for the current slave driving module, and sending the adjustment strategy of downward fine adjustment to a previous slave driving module.

In a Step S3, the main driving module determines the adjustment strategy of the power supply according to the adjustment strategy from the connected slave driving module and the output port voltages of the main driving module, and uses a fine adjustment gear to fine-adjust the power supply.

Specifically, in an embodiment of the present application, after the abnormal port is removed and the coarse adjustment is performed, the main driving module compares the output port voltages of the normal ports with the feedback voltage threshold. If the output port voltage of any one normal port of the main driving modules is less than the lower limit of the feedback voltage threshold, the adjustment strategy of the main driving module is upward adjustment with one gear. This adjustment is a fine adjustment on the supply voltage of the power supply of the LED system, and the adjustment step is small, such as 0.6V/step. If the output port voltages of all the normal output ports in the main driving module are greater than the upper limit of the feedback voltage threshold, the adjustment strategy of the main driving module is downward adjustment with one gear. At this time, if the inter-chip communication unit does not receive the adjustment strategy of upward adjustment with one gear from the subsequent slave driving module, the adjustment strategy of the main driving module is downward adjustment with one gear.

Therefore, in the Step S3, when the output port voltages of the multiple output ports of the main driving module are not all greater than the lower limit of the feedback voltage threshold or the adjustment strategy from the subsequent slave driving module is upward fine adjustment, the supply voltage of the power supply is fine-adjusted upward; and when the output port voltages of the multiple output ports of the main driving module are all greater than the upper limit of the feedback voltage threshold and the adjustment strategy from the subsequent slave driving module is not the upward fine adjustment, the supply voltage of the power supply is fine-adjusted downward.

Although the embodiments of the present application have been described with reference to the accompanying drawings, those skilled in the art can make various modifications and variations without departing from the spirit and scope of the present application, and such modifications and variations fall within the scope defined by the appended claims.

The invention claimed is:

1. A control method for power supply of an LED system, used in an LED drive circuit comprising a main driving module connected to the power supply and multiple cascaded slave driving modules, comprising the following steps:

S1. Detecting multiple output port voltages of multiple output ports of the main driving module, and when a number of ports whose output port voltage is less than a first preset voltage or a number of ports whose output port voltage is greater than a second preset voltage exceeds a first preset value, coarsely adjusting the power supply with a coarse adjustment gear;

S2. Determining by each of the multiple slave driving modules an adjustment strategy of a current slave driving module according to output port voltages of the current slave driving module and an adjustment strategy from a subsequent slave driving module, and sending the adjustment strategy to a previous slave driving module;

S3. Determining by the main driving module an adjustment strategy of the power supply according to the adjustment strategy from the slave driving module that is connected with the main driving module and the output port voltages of the main driving module, and fine-adjusting the power supply with a fine adjustment gear.

2. The control method according to claim 1, wherein the step S1 comprises:

S11. Detecting multiple output port voltages of multiple output ports of the main driving module;

S12. Counting a number of ports whose voltage is less than a first preset voltage and a number of ports whose voltage is greater than a second preset voltage among the multiple output ports;

S13. When the number of ports whose voltage is less than the first preset voltage in the multiple output ports is greater than a first preset value, coarsely adjusting the power supply upward, and when the number of ports whose voltage is greater than the second preset voltage in the multiple output ports is greater than the first preset value, coarsely adjusting the power supply downward.

3. The control method according to claim 1, wherein the step S2 comprises:

S21. Detecting output port voltages of multiple output ports of a current slave driving module;

S22. Determining whether the output port voltages are all greater than a lower limit of a feedback voltage threshold, if yes, proceeding to Step S24, and if not, proceeding to Step S23;

S23. Generating an adjustment strategy of upward fine adjustment for the current slave driving module, and sending the adjustment strategy of upward fine adjustment to a previous slave driving module;

S24. Determining whether the output port voltages are all greater than an upper limit of the feedback voltage threshold, if yes, proceeding to Step S25;

S25. Determining whether an adjustment strategy from a subsequent slave driving module is upward fine adjustment, if yes, proceeding to Step S23, and if not, generating an adjustment strategy of downward fine adjustment for the current slave driving module, and sending the adjustment strategy of downward fine adjustment to the previous slave driving module.

4. The control method according to claim 3, wherein in the Step S3, when the output port voltages of the multiple output ports of the main driving module are not all greater than the lower limit of the feedback voltage threshold or the adjustment strategy from the subsequent slave driving module is upward fine adjustment, the power supply is fine-adjusted upward; and when the output port voltages of the multiple output ports of the main driving module are all greater than the upper limit of the feedback voltage threshold and the adjustment strategy from the subsequent slave driving module is not the upward fine adjustment, the power supply is fine-adjusted downward.

5. The control method according to claim 1, wherein before the step S1, the control method further comprises:

S0. Performing by the main driving module an initial adjustment with an initial adjustment gear on the power supply according to a number of series-connected light points and a supply gear of the power supply detected when power-on.

6. The control method according to claim 5, wherein between the Step S1 and the Step S2, the control method further comprises:

S01. Determining whether the output port voltages of the main driving module and the multiple slave driving modules are abnormal, if any one is abnormal, the output port voltage is not used in a calculation of the adjustment strategy.

7. A control device for power supply of an LED system, connected to the power supply of the LED system, comprising a port voltage detection unit, a feedback calculation unit and a feedback unit, wherein the port voltage detection unit is configured to detect output port voltages of multiple output ports; the feedback calculation unit is configured to generate a coarse adjustment strategy when a number of ports whose output port voltage is less than a first preset voltage or a number of ports whose output port voltage is greater than a second preset voltage exceeds a first preset value, and is further configured to generate a fine adjustment strategy based on the output port voltages and a feedback voltage threshold after a coarse adjustment is performed; and the feedback unit is configured to adjust a supply voltage of the power supply according to a feedback voltage adjustment step, the coarse adjustment strategy and the fine adjustment strategy.

8. The control device according to claim 7, wherein the control device further comprises a power supply detection unit and an adjustment unit; the power supply detection unit is configured to obtain the supply voltage of the power supply of the LED system by means of resistance voltage division; the adjustment unit is configured to determine the feedback voltage adjustment step; the feedback calculation unit is further configured to determine a supply gear of the power supply according to the supply voltage, and generates an initial adjustment strategy according to the supply gear and a number of series-connected light points; and the feedback unit is further configured to adjust the supply voltage of the power supply according to the feedback voltage adjustment step and the initial adjustment strategy.

9. The control device according to claim 8, wherein the control device further comprises an inter-chip communication unit which is configured for inter-chip transmission of adjustment strategies.

10. An LED system with a controllable power supply, comprising a power supply, an LED driving circuit and LED light strings, the LED driving circuit comprising a main driving module and multiple cascaded slave driving modules, wherein the main driving module and the multiple slave driving modules are configured with a control device for power supply of the LED system; the main driving module detects multiple output port voltages of multiple output ports of the main driving module, and when a number of ports whose output port voltage is less than a first preset voltage or a number of ports whose output port voltage is greater than a second preset voltage exceeds a first preset value, coarsely adjusts the power supply with a coarse adjustment gear; each of the multiple slave driving modules determines an adjustment strategy of a current slave driving module according to output port voltages of the current slave driving module and an adjustment strategy from a subsequent slave driving module, and sends the adjustment strategy to a previous slave driving module; and the main driving module determines an adjustment strategy of the power supply according to the adjustment strategy from the slave driving module that is connected with the main driving module and the output port voltages of the main driving module, and fine-adjusting the power supply with a fine adjustment gear.

11. The LED system according to claim 10, wherein the control device in the main driving module comprises a port voltage detection unit, a feedback calculation unit and a feedback unit, wherein the port voltage detection unit is configured to detect output port voltages of multiple output ports; the feedback calculation unit is configured to generate a coarse adjustment strategy when a number of ports whose output port voltage is less than a first preset voltage or a number of ports whose output port voltage is greater than a second preset voltage exceeds a first preset value, and is further configured to generate a fine adjustment strategy based on the output port voltages and a feedback voltage threshold after a coarse adjustment is performed; and the feedback unit is configured to adjust a supply voltage of the power supply according to a feedback voltage adjustment step, the coarse adjustment strategy and the fine adjustment strategy.

12. The LED system according to claim 11, wherein the control device in the main driving module further comprises a power supply detection unit and an adjustment unit; the power supply detection unit is configured to obtain the supply voltage of the power supply of the LED system by means of resistance voltage division; the adjustment unit is configured to determine the feedback voltage adjustment step; the feedback calculation unit is further configured to determine a supply gear of the power supply according to the supply voltage, and generates an initial adjustment strategy according to the supply gear and a number of series-connected light points; and the feedback unit is further configured to adjust the supply voltage of the power supply according to the feedback voltage adjustment step and the initial adjustment strategy.

13. The LED system according to claim 11, wherein the control device in the main driving module further comprises an inter-chip communication unit which is configured for inter-chip transmission of adjustment strategies.

14. The LED system according to claim 11, wherein the control device in each of the multiple slave driving modules comprises a port voltage detection unit, a feedback calculation unit, and an inter-chip communication unit; the port voltage detection unit is configured to detect output port voltages of a current slave driving module; the feedback calculation unit is configured to calculate an adjustment strategy of the current slave driving module; and the inter-chip communication unit is configured for inter-chip transmission of the adjustment strategy.

15. The LED system according to claim 14, wherein the feedback calculation unit determines the adjustment strategy of the current slave driving module according to the output port voltages of the current slave driving module and an adjustment strategy from a subsequent slave driving module, and send the adjustment strategy to a previous slave driving module through the inter-chip communication unit.

* * * * *